US008657148B2

(12) United States Patent
Krammes et al.

(10) Patent No.: US 8,657,148 B2
(45) Date of Patent: Feb. 25, 2014

(54) DRINKING CONTAINER LID WITH SOFT SPOUT

(75) Inventors: John Krammes, Chelmsford, MA (US); James J. Britto, Westport, MA (US)

(73) Assignee: Learning Curve Brands, Inc., Dyersville, IA (US)

( * ) Notice: Subject to any disclaimer, the term of this patent is extended or adjusted under 35 U.S.C. 154(b) by 0 days.

(21) Appl. No.: 12/596,353

(22) PCT Filed: Apr. 18, 2008

(86) PCT No.: PCT/US2008/060904

§ 371 (c)(1), (2), (4) Date: Oct. 16, 2009

(87) PCT Pub. No.: WO2008/131281

PCT Pub. Date: Oct. 30, 2008

(65) Prior Publication Data

US 2010/0127006 A1 May 27, 2010

Related U.S. Application Data

(60) Provisional application No. 60/912,999, filed on Apr. 20, 2007.

(51) Int. Cl.
*B65D 83/28* (2006.01)
*A47G 19/22* (2006.01)

(52) U.S. Cl.
USPC ..... 220/705; 215/388; 222/490; 220/714

(58) Field of Classification Search
USPC ..... 215/11.4, 11.5, 11.6; 220/305, 717, 220/705, 714; 222/490
See application file for complete search history.

(56) References Cited

U.S. PATENT DOCUMENTS 5,101,991 A * 4/1992 Morifuji et al. ..... 215/11.1
5,890,621 A * 4/1999 Bachman et al. ..... 220/717

(Continued)

FOREIGN PATENT DOCUMENTS

JP 2002530253 9/2002
JP 2006230731 9/2005

OTHER PUBLICATIONS

PCT/US2008/060904 International Search Report and Written Opinion dated Aug. 26, 2008 (8 pages).

(Continued)

*Primary Examiner* — Anthony Stashick
*Assistant Examiner* — Kevin Castillo
(74) *Attorney, Agent, or Firm* — Michael Best & Friedrich LLP

(57) ABSTRACT

A container including a main body and a removable lid. The main body defines an interior cavity accessible through an opening at an upper end of the main body, and the main body has a rim about the opening. The removable lid secures to the rim of the main body to enclose the interior cavity. The removable lid includes an upper portion having a convex surface and comprises a soft, flexible material. The removable lid also includes a spout integrally molded with the upper portion and extending from the upper portion at an off-center location. The spout is shaped and sized to be received inside a child's mouth. The spout includes a wall and a flexible membrane supported by the wall. The membrane has a convex surface facing a distal end of the spout and forming a cavity within the distal end of the spout, and a valve configured to provide fluid communication between the interior cavity and the child's mouth when sufficient pressure is applied to the distal end of the spout.

18 Claims, 1 Drawing Sheet

(56) References Cited

U.S. PATENT DOCUMENTS

| | | | | |
|---|---|---|---|---|
| 6,050,445 | A | 4/2000 | Manganiello | |
| 6,102,245 | A | 8/2000 | Haberman | |
| 6,116,457 | A | 9/2000 | Haberman | |
| 6,131,806 | A | 10/2000 | Hess, III et al. | |
| 6,230,923 | B1 | 5/2001 | Hung | |
| 6,269,968 | B1 | 8/2001 | Belcastro | |
| 6,321,931 | B1 | 11/2001 | Hakim et al. | |
| 6,325,236 | B1 * | 12/2001 | Wong | 220/713 |
| 6,357,620 | B1 | 3/2002 | Hakim | |
| 6,422,415 | B1 | 7/2002 | Manganiello | |
| 6,629,624 | B2 | 10/2003 | Stillinger et al. | |
| 6,631,823 | B2 | 10/2003 | Stillinger et al. | |
| 6,732,882 | B2 | 5/2004 | Belcastro | |
| 6,745,915 | B2 | 6/2004 | Rees | |
| 6,758,364 | B1 | 7/2004 | Rohrig | |
| 6,786,352 | B2 | 9/2004 | Belcastro | |
| RE38,692 | E | 2/2005 | Wong | |
| 6,880,713 | B2 | 4/2005 | Holley, Jr. | |
| 6,923,337 | B2 | 8/2005 | Hession et al. | |
| 6,942,121 | B1 | 9/2005 | Northup et al. | |
| 6,994,225 | B2 | 2/2006 | Hakim | |
| 7,070,065 | B2 | 7/2006 | Wong | |
| 7,147,121 | B2 | 12/2006 | Boucher et al. | |
| 2005/0045647 | A1 * | 3/2005 | Hession et al. | 220/714 |
| 2006/0060590 | A1 | 3/2006 | Goeking et al. | |
| 2006/0201902 | A1 | 9/2006 | Brown et al. | |
| 2006/0226146 | A1 | 10/2006 | Haberman | |
| 2006/0261064 | A1 | 11/2006 | Holley, Jr. | |
| 2007/0051727 | A1 | 3/2007 | Holley, Jr. | |
| 2007/0068893 | A1 | 3/2007 | Eidson | |

OTHER PUBLICATIONS

The First Years—Ideas Inspired by Parents, Trade Catalog, 1113 Natural Feeding Starter Set, p. 6, 2000.

* cited by examiner

DRINKING CONTAINER LID WITH SOFT SPOUT

RELATED APPLICATION

This application claims the benefit of U.S. Provisional Patent Application Ser. No. 60/912,999 filed on Apr. 20, 2007. The contents of Application Ser. No. 60/912,999 are incorporated herein by reference.

BACKGROUND

Children's drinking cups are generally provided with removable lids, to help prevent large spills. Commonly, these lids have drinking spouts extending from their upper surface, that children place in their mouths to sip from the cups. Such cups are sometimes called "sippy cups." Some sippy cup spouts have open slots or holes through which the liquid in the cup flows when the cup is inverted. Such slots or holes are generally sized for an acceptably high flow rate, for ease of cleaning, and to enable the passage of small drink particulates such as pulp in orange juice.

Many parents understandably prefer sippy cups with valves that close off any flow opening in the spout until suction is supplied by the child, instead of permanently open holes or slots. The design of such valves traditionally entails a trade-off between flow rate during drinking and leak rate when not in use. Also, many such valves can be difficult to properly clean. Some valves are removable and can be misplaced. Some sippy cup valves are in the form of a flexible membrane with a normally closed slit which opens sufficiently under pressure to enable acceptable flow.

SUMMARY

The invention includes a container having a removable lid with flexible soft spout.

The invention provides a container comprising a main body and a removable lid. The main body defines an interior cavity accessible through an opening at an upper end of the main body, and the main body has a rim about the opening. The removable lid secures to the rim of the main body to enclose the interior cavity. The removable lid includes an upper portion having a convex surface and comprises a soft, flexible material. The removable lid also includes a spout integrally molded with the upper portion and extending from the upper portion at an off-center location. The spout is shaped and sized to be received inside a child's mouth. The spout includes a wall and a flexible membrane supported by the wall. The membrane has a convex surface facing a distal end of the spout and forming a cavity within the distal end of the spout, and a valve configured to provide fluid communication between the interior cavity and the child's mouth when sufficient pressure is applied to the distal end of the spout.

The invention also provides a lid for a container. The lid comprises an outer wall and an inner wall forming a recess configured to engage a rim of the container and a channel; a domed cover having a portion received within the recess and contacting a top surface of the rim of the container; a spout integrally molded with the cover and extending from the cover at an off-center location, the spout shaped and sized to be received inside a child's mouth, the spout including a wall and a flexible membrane supported by the wall, the membrane having a convex surface facing a distal end of the spout and forming a cavity within the distal end of the spout, and a valve configured to provide fluid communication between the interior cavity and the child's mouth when sufficient pressure is applied to the distal end of the spout.

Other aspects of the invention will become apparent by consideration of the detailed description and accompanying drawings.

BRIEF DESCRIPTION OF THE DRAWING

The FIGURE is a side cross-sectional view of a lid for a container according to one embodiment of the present invention.

DETAILED DESCRIPTION

Figure 1:
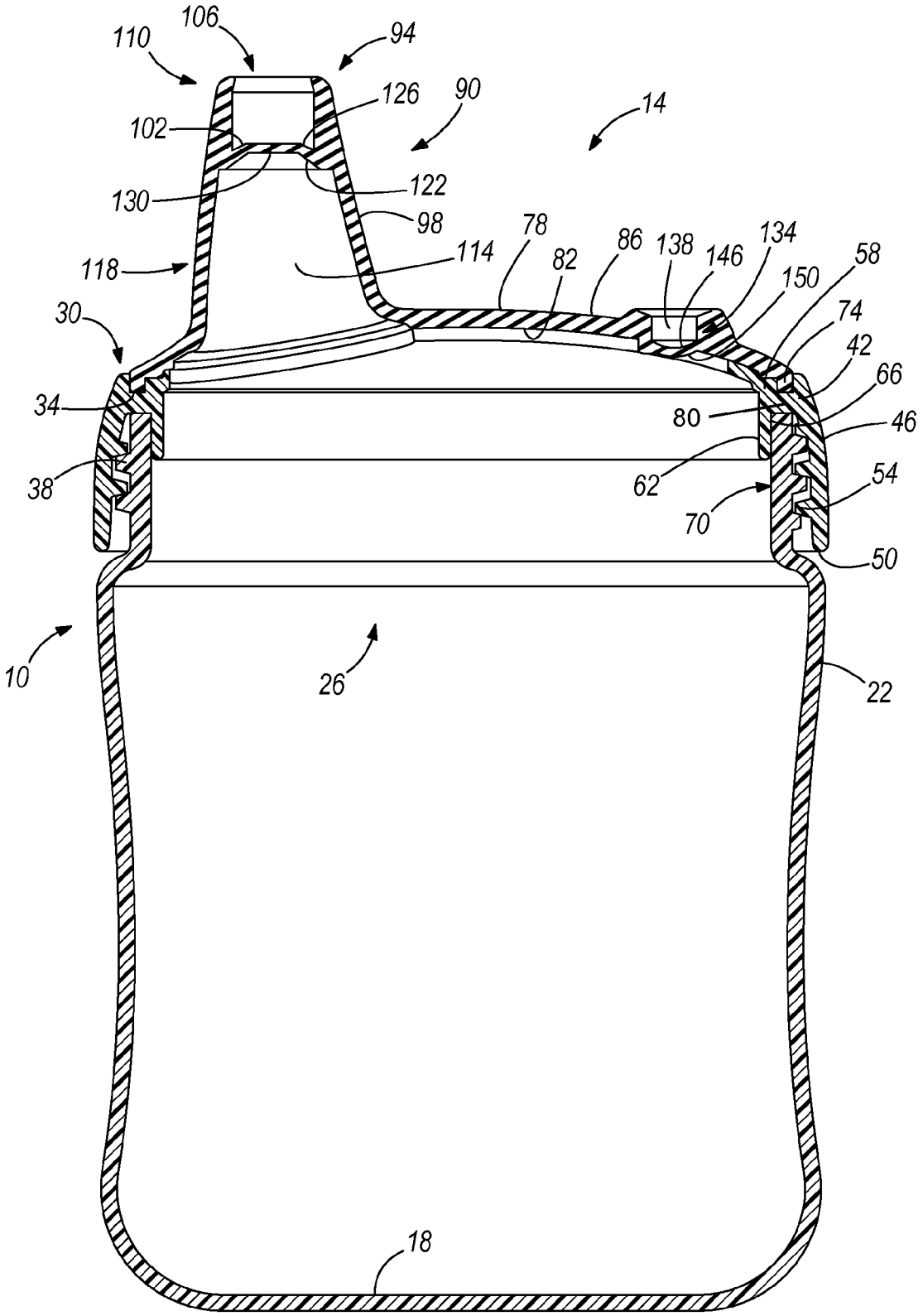

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

The FIGURE illustrates a container 10 having a lid 14. The container 10 includes a bottom wall 18 and a side wall 22 extending upward from the bottom wall 18 that define an interior 26. The container 10, as illustrated in the FIGURE is generally circular shaped, but could also include other suitable shapes, such as oval, square, rectangular, or irregular shapes. The side wall 22 includes an upper portion 30 adapted to receive the lid 14. The upper portion 30 includes a rim 34 and threads 38 for engaging complementary threads on the lid 14.

The container 10 can be molded from a suitable polypropylene material having a suitable thickness and durability. Other suitable materials and/or combinations of materials may also be used to manufacture the container 10. The lid 14 also can be molded from a suitable polypropylene material having a suitable thickness, but is not limited to polypropylene material.

The lid 14 includes an outer wall 42 having an outer surface 46 and an inner surface 50. The inner surface 50 includes threads 54 adapted to engage the threads 38 on the container 10 as mentioned above. The inner surface 50 is coupled to an inner wall 58 having an inner surface 62 and an outer surface 66. In other words, the inner wall 58 is spaced radially inward of the outer wall 42 by an intermediate wall 80 thereby defining a recess 70 at a lower portion of the lid 14 and a channel 74 at an upper portion of the lid 14. The recess 70 and the channel 74 are on opposite sides of the intermediate wall 80. The recess is defined by the inner surface 50 of the outer wall 42 and the outer surface 66 of the inner wall 58. The recess 70 is adapted to receive the upper portion 30 of the container 10.

The channel 74 is defined by portions of the outer wall 42 and the inner wall 58 that extend above the rim 34 of the container 10. The channel 74 is adapted to receive an upper portion 78 of the lid 14. The inner wall 58 extends further to an underside surface of the upper portion 78 of the lid 14 and provides additional support to the upper portion 78.

The upper portion 78 of the lid 14 is comprised of a soft and flexible material, such as TPE or silicone. The upper portion 78 is generally dome-shaped and includes an inner surface 82 in communication with the interior 26 of the container 10 and an outer surface 86. The lid 14 also includes an integrally molded spout 90 extending upward from the upper portion 78 to a distal end 94 shaped and sized to be comfortably received in a child's mouth for drinking. The spout 90 includes a wall 98 and a membrane 102 positioned within the spout 90 and being integral with the wall 98. The spout 90 includes a first cavity 106 generally defined by the wall 98 of an upper portion 110 of the spout 90 and the membrane 102 and a second cavity 114 generally defined by the wall 98 of a lower portion 118 of the spout 90 and the membrane 102. The second cavity 114 is in fluid communication with the interior 26 of the container 10.

The membrane 102 is comprised of the same soft and flexible material as used for the upper portion 78 of the lid 14, but could also be comprised of other suitable materials and/or combinations of materials. The membrane 102 is generally dome-shaped, thus having a concave inner surface 122 in communication with the second cavity 114 and a convex outer surface 126 in communication with the first cavity 106. The membrane 102 includes a valve 130, such as a slit that extends through the inner surface 122 and outer surface 126. The valve 130 remains closed until an adequate force of suction or a vacuum is applied to the membrane 102 causing the valve 130 to open and allow fluid flow from the interior 26 through the valve 130 and into the first cavity 106. When sufficient suction or vacuum is released, the valve 130 returns to the closed position to prevent fluid leakage.

The lid 14 also includes a recess 134 in the upper portion 78 and is adapted to receive a plug 138 forming a vent that allows air into the interior 26 of the container 10 when the suction or vacuum is applied to the spout 90. The recess 134 includes a membrane 142 having a concave outer surface 146 and a convex inner surface 150. The vent is formed in the upper portion 78 of the lid 14 such that fluid does not leak from the container 10.

Various features and advantages of the invention are set forth in the following claims.

What is claimed is:

1. A container comprising:

a main body defining an interior cavity accessible through an opening at an upper end of the main body, the main body having a rim about the opening; and a lid removably secured to the rim of the main body to enclose the interior cavity, the removable lid including an outer wall integrally connected to an inner wall, the inner wall spaced radially inward of the outer wall by an intermediate wall thereby defining a recess and a channel, the recess and the channel positioned on opposite sides of the intermediate wall, the recess configured to receive the rim of the main body;

an upper portion received within the channel, the upper portion formed of a soft, flexible material, the upper portion having a convex surface, and a spout integrally molded with the upper portion and extending from the upper portion at a location offset from a center of the lid, the spout shaped and sized to be received inside a child's mouth, the spout including a wall and a flexible membrane formed from the wall, the membrane having a convex surface facing a distal end of the spout and forming a cavity within the distal end of the spout, and a valve formed within the membrane and configured to provide fluid communication between the interior cavity and the child's mouth when sufficient pressure is applied to the distal end of the spout.

2. The container as set forth in claim 1 wherein fluid in the main body is retained when sufficient pressure is removed from the distal end of the spout.

3. The container as set forth in claim 1 wherein the membrane is comprised of the same soft, flexible material as the upper portion of the lid.

4. The container as set forth in claim 1 wherein the valve is a slit.

5. The container as set forth in claim 1 wherein the lid further includes a recess formed in the upper portion and a plug configured to be received in the recess forming a vent for allowing air to enter into the interior cavity of the main body when suction is applied to the spout.

6. The container as set forth in claim 5 wherein the recess in the upper portion includes a convex surface in communication with the interior cavity of the main body.

7. A lid for a container, the lid comprising:

an outer wall integrally connected to an inner wall, the inner wall spaced radially inward of the outer wall by an intermediate wall thereby forming a recess and a channel, the recess and the channel positioned on opposite sides of the intermediate wall, the recess configured to engage a rim of the container;

a domed cover having a portion received within the channel and contacting a top surface of the inner wall;

a spout integrally molded with the cover and extending from the cover at an off-center location, the spout shaped and sized to be received inside a child's mouth, the spout including a wall and a flexible membrane formed from the wall, the membrane having a convex surface facing a distal end of the spout and forming a cavity within the distal end of the spout, and a valve configured to provide fluid communication between the interior cavity and the child's mouth when sufficient pressure is applied to the distal end of the spout; and a recess formed in the cover and offset from the spout, and a plug configured to be received in the recess in the cover thereby forming a vent for allowing air to enter into the container when suction is applied to the spout.

8. The lid as set forth in claim 7 wherein fluid in the container is retained when sufficient pressure is removed from the distal end of the spout.

9. The lid as set forth in claim 7 wherein the membrane and the cover are comprised of a soft, flexible material.

10. The container as set forth in claim 7 wherein the valve is a slit.

11. The container as set forth in claim 7 wherein the recess in the cover includes a convex surface in communication with the container.

12. A sippy cup comprising:

a main body defining an interior cavity accessible through an opening at an upper end of the main body, the main body having a rim about the opening; and a lid removably secured to the rim of the main body to enclose the interior cavity, the removable lid including an outer wall integrally connected to an inner wall, the inner wall spaced radially inward of the outer wall by an intermediate wall thereby defining a recess and a channel, the recess and the channel positioned on opposite sides of the intermediate wall, the recess configured to receive the rim of the main body;

an upper portion received within the channel, the upper portion formed of a soft, flexible material, and a spout integrally molded with the upper portion and extending from the upper portion at a location offset from a center of the lid, the spout shaped and sized to be received inside a child's mouth, the spout including a wall and a flexible membrane formed from the wall, the membrane including a valve configured to provide fluid communication between the interior cavity and the child's mouth when sufficient pressure is applied to the distal end of the spout.

13. The sippy cup as set forth in claim 12 wherein the valve is a slit.

14. The sippy cup as set forth in claim 12 wherein the lid further includes a recess formed in the upper portion and a plug configured to be received in the recess forming a vent for allowing air to enter into the interior cavity of the main body when suction is applied to the spout.

15. The sippy cup as set forth in claim 14 wherein the recess in the upper portion includes a convex surface in communication with the interior cavity of the main body.

16. The sippy cup as set forth in claim 12 wherein the lid and the main body include threads configured for engagement and to thereby enclose the interior cavity.

17. The container as set forth in claim 1 wherein the lid further includes a vent for allowing air to enter into the interior cavity of the main body when suction is applied to the spout.

18. The sippy cup as set forth in claim 12 wherein the lid further includes a vent for allowing air to enter into the interior cavity of the main body when suction is applied to the spout.

* * * * *